US010882672B2

(12) United States Patent
Paganuzzi

(10) Patent No.: US 10,882,672 B2
(45) Date of Patent: Jan. 5, 2021

(54) SAFETY CAPSULE FOR A CONTAINER

(71) Applicant: BORMIOLI PHARMA S.R.L., Milan (IT)

(72) Inventor: Valerio Paganuzzi, Parma (IT)

(73) Assignee: BORMIOLI PHARMA S.P.A., Milan (IT)

( * ) Notice: Subject to any disclaimer, the term of this patent is extended or adjusted under 35 U.S.C. 154(b) by 284 days.

(21) Appl. No.: 16/061,380

(22) PCT Filed: Oct. 27, 2016

(86) PCT No.: PCT/IB2016/056485

§ 371 (c)(1),
(2) Date: Jun. 12, 2018

(87) PCT Pub. No.: WO2017/109599

PCT Pub. Date: Jun. 29, 2017

(65) Prior Publication Data

US 2018/0362229 A1 Dec. 20, 2018

(30) Foreign Application Priority Data

Dec. 23, 2015 (IT) ..... 102015000087244

(51) Int. Cl.
*B65D 51/28* (2006.01)
*B65D 51/20* (2006.01)

(52) U.S. Cl.
CPC ..... *B65D 51/285* (2013.01); *B65D 51/20* (2013.01); *B65D 51/2842* (2013.01);
(Continued)

(58) Field of Classification Search
CPC .. B65D 51/285; B65D 51/20; B65D 2401/15; B65D 2401/20; B65D 2401/25;
(Continued)

(56) References Cited

U.S. PATENT DOCUMENTS 2,073,273 A * 3/1937 Korn ..... B01F 3/04801 99/323.2
3,840,136 A * 10/1974 Lanfranconi ..... B65D 51/226 215/6

(Continued)

FOREIGN PATENT DOCUMENTS

CN 1827482 A 9/2006
DE 29820062 2/1999

(Continued)

*Primary Examiner* — Ernesto A Grano
(74) *Attorney, Agent, or Firm* — Pearne & Gordon LLP

(57) ABSTRACT

A closure capsule for closing a container, comprising: a cap (2) to be associated with the container and comprising a frangible mouth (20); a cutter (3) for opening said frangible mouth (20); a covering (4) protecting said cap (2) and said cutter (3) and comprising an intactness band (40); first toothed connection means (5) afforded on the covering (4) and on the cutter (3) and that make said cutter (3) and said covering (4) rotate integrally. The closure capsule is movable from a initial configuration to an operative configuration, wherein the intactness band is removed and the frangible mouth is broken. In the initial configuration, the cap, the cutter and the covering contribute to the definition of walls of a reservoir (8) for containing a product to be dropped into the container in the operative configuration.

11 Claims, 3 Drawing Sheets

(52) U.S. Cl.
CPC ..... *B65D 2401/15* (2020.05); *B65D 2401/20* (2020.05); *B65D 2401/25* (2020.05)

(58) Field of Classification Search
CPC .... B65D 2585/56; B65D 51/28; B65D 51/26; B65D 47/148; B65D 47/0885; B65D 23/00
USPC ..... 215/235, 257
See application file for complete search history.

(56) References Cited

U.S. PATENT DOCUMENTS 4,195,731 A * 4/1980 Cavazza ..... B65D 81/3222 206/222
4,982,875 A 1/1991 Pozzi et al.
5,465,835 A 11/1995 Schumacher et al.
5,927,549 A * 7/1999 Wood ..... B65D 51/285 206/222
6,148,996 A * 11/2000 Morini ..... B65D 51/285 206/222
6,705,462 B2 * 3/2004 Kasuya ..... B65D 25/08 206/222
7,748,550 B2 7/2010 Cho
8,215,481 B1 * 7/2012 Knickerbocker .... B65D 51/285 206/222
2002/0020636 A1 * 2/2002 Bergamini ..... A61J 1/2093 206/219
2005/0161348 A1 * 7/2005 Morini ..... B65D 41/3438 206/219
2006/0108314 A1 5/2006 Cho
2008/0093326 A1 * 4/2008 Cho ..... B65D 51/285 215/228
2008/0142473 A1 6/2008 Cho
2008/0202949 A1 * 8/2008 Morini ..... B65D 51/285 206/219
2008/0314775 A1 12/2008 Owoc
2010/0059394 A1 * 3/2010 Fontana ..... B65D 51/285 206/222
2010/0116699 A1 * 5/2010 Sorenson ..... B65D 51/285 206/219
2010/0282624 A1 11/2010 Paganuzzi
2011/0147414 A1 * 6/2011 Chen ..... B65D 51/285 222/83
2012/0279879 A1 11/2012 Lee et al.
2012/0325697 A1 * 12/2012 Cho ..... B65D 51/285 206/219
2013/0105433 A1 * 5/2013 Chen ..... B65D 51/285 215/227
2013/0313138 A1 11/2013 Thoman
2014/0017363 A1 * 1/2014 Aibe ..... A23L 29/272 426/115
2014/0048507 A1 * 2/2014 Brambilla ..... B65D 23/02 215/257
2015/0203261 A1 * 7/2015 Lee ..... B65D 51/285 206/219
2015/0239638 A1 * 8/2015 Lee ..... B65D 51/2864 206/222
2016/0264323 A1 * 9/2016 Jeon ..... B65D 51/285
2017/0107030 A1 4/2017 Presche
2018/0208372 A1 * 7/2018 Rovelli ..... B65D 81/22

FOREIGN PATENT DOCUMENTS

DE 102014113391 A1 11/2015
EP 0561322 A1 9/1993
EP 2321192 A1 5/2011
JP S59168340 10/1984

* cited by examiner

SAFETY CAPSULE FOR A CONTAINER

TECHNICAL FIELD

The object of the present invention is a closure capsule for closing a container, a method for assembling said closure capsule and a method for opening a container occluded by the capsule.

STATE OF THE ART

A safety capsule with a frangible reservoir is known and disclosed in patent EP 2321192. This capsule comprises:

- a cap that occludes a mouthpiece of a container and comprises a frangible bottom;
- a cutter designed to open said frangible mouth following translational movement induced by pressure acting upon it. The cutter is hollow and, in combination with the frangible mouth, it defines a reservoir, the inside of which receives a solute to be dissolved in the solvent present in the container.
- a cover that protects said capsule and said cutter and comprises an intactness band that must be removed before the frangible bottom can be broken and the solute and solvent mixed. After removal of the intactness band, initial tightening of the cover on the cap pushes the cutter, thereby opening the frangible mouth.

AIM OF THE INVENTION

The aim of the present invention is to offer a closure capsule for closing a container, a method for assembling said closure capsule and a method for opening the container, the capsule and both methods enabling the insertion of significant volumes of solute in the capsule.

The defined technical task and the specified aims are substantially achieved by a closure capsule for closing a container, a method for assembling said closure capsule and a method for opening the container comprising the technical characteristics set forth in one or more of the appended claims.

BRIEF DESCRIPTION OF THE DRAWINGS

Further characteristics and advantages of the present invention will become more apparent from the approximate and thus non-limiting description of a closure capsule for closing a container as illustrated in the attached drawings, of which.

DETAILED DESCRIPTION OF PREFERRED EMBODIMENTS OF THE INVENTION

Figure 1:
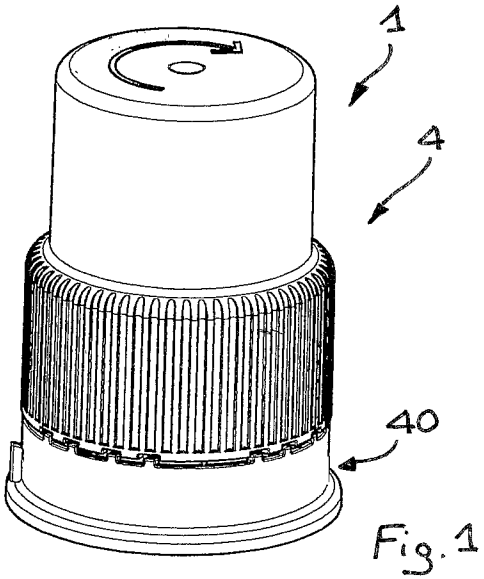
FIG. 1 is a perspective view of a capsule according to the present invention.
Figure 2:
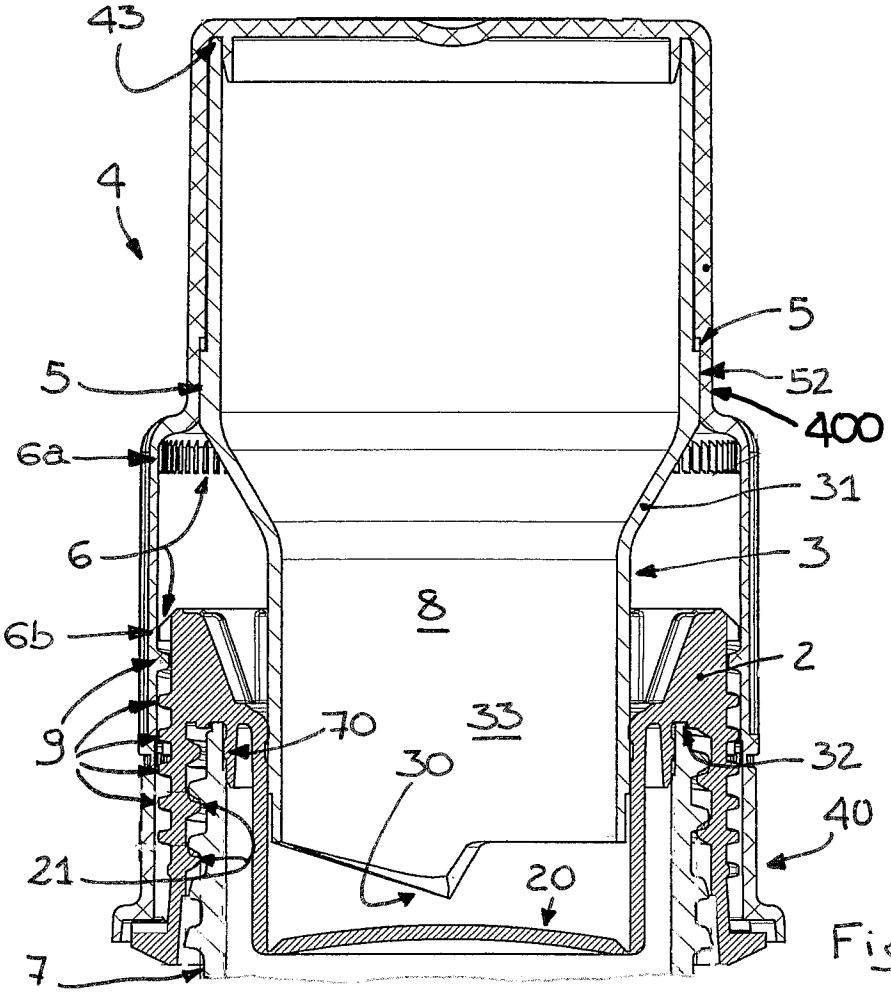
FIG. 2 is a sectional view showing the capsule of FIG. 1 connected to a container.
Figure 3:
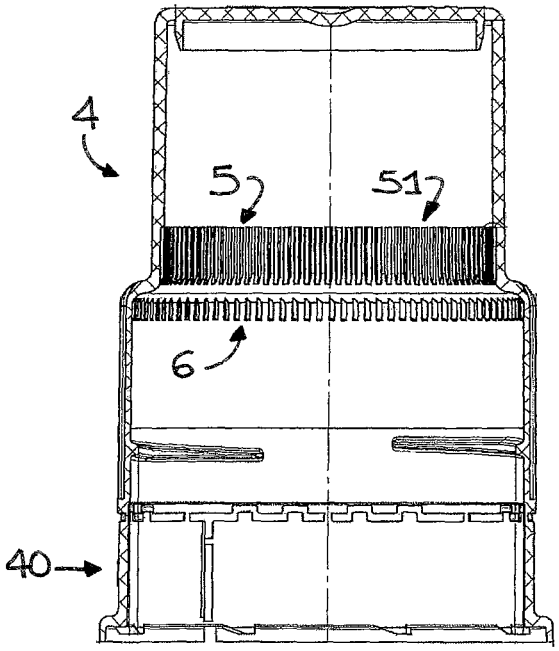
FIG. 3 is a view of a component of the capsule of FIG. 2.

A closure capsule for closing a container is indicated by reference number 1 in the attached figures.

The capsule 1 conveniently comprises a cap 2 that can be associated with a container. In particular, the cap 2 can be associated with a mouthpiece of the container. In this regard, the cap 2 comprises an internal annular surface comprising a thread 21 suitable for interacting with a corresponding thread afforded on the container. The cap 3 conveniently comprises an annular seat 32 designed to receive one end of the mouthpiece of the container.

The cap 2 further comprises a frangible mouth 20. The frangible mouth 20 is designed to be positioned inside the container.

The capsule 1 comprises a cutter 3 designed to open the frangible mouth 20.

The capsule 1 also comprises a covering 4 that protects both said cap 2 and said cutter 3. Conveniently, both the covering 4 and the cutter 3 are made of a plastic material.

The covering 4 makes it possible to prevent a user from being able to unscrew the cap 2 without having first broken the frangible mouth 20 by means of the cutter 3.

The covering 4 conveniently comprises an intactness band 40. The intactness band 40 must be removed in order to permit the container occluded by the capsule 1 to be opened. In the rest configuration, the intactness band 40 defines a strip at the base of the covering 4.

The closure capsule 1 is movable from a rest configuration, in which the frangible mouth 20 and the intactness band 40 are intact, to an operative configuration, in which the intactness band 40 is removed and the frangible mouth 20 is broken.

In the rest configuration, the cap 2, the cutter 3 and the covering 4 contribute to the definition of walls of a reservoir 8 for containing a product, this product being intended to drop into the container when the capsule 1 takes on the operative configuration. Advantageously, the product 8 in the reservoir is powdered or granular. This product is a solute intended to be dissolved in a substance (solvent) contained in the container 7. The cutter 3 and the covering 4 are physically separate pieces. Advantageously, the cutter 3 consists of a single piece. The cutter 3 is a body that defines a cavity 33 within which it is possible to house at least part of the product (solute). Likewise, the cap 2 consists of a single piece.

The capsule 1 comprises first toothed connection means 5 afforded on the covering 4 and on the cutter 3. In particular, the first connection means 5 comprise a first part 51 afforded on a surface of the covering 4 (suitably facing inwards) and a second part 52 afforded on a surface of the cutter 3 (suitably facing outwards); these parts 51, 52 face each other. The first connection means 5 interact with each other and thereby make said cutter 3 and at least a first part 400 of the covering 4 (advantageously, the entire covering 4) rotate integrally.

The capsule 1 also comprises threaded connection means 9, which, in passing from the rest configuration to the operative configuration, couple the covering 4 and the cap 2, thereby enabling rotational-translational movement of the first part 400 of the covering 4 and the cutter 3 with respect to said cap 2. Advantageously, the operative configuration can be defined as a limit stop of the rotational-translational movement of the first part 400 of the covering 4 and the cutter 3 with respect to the cap 2 (as it moves away from the rest configuration).

The cutter 3 comprises a cutting edge 30. The cutter 3 also comprises a widening zone 31, in which, as it moves away from the cutting edge 30, the cross section of the cutter 3 (and thus the cross section of the reservoir 8) increases. This "cross" section is assessed with respect to an axial direction for tightening the covering 4 on the cap 2. In particular, the section of the cutter 3 widens perpendicularly to the axial direction for tightening the covering 4 on the cap 2. As illustrated by way of example in the attached figures, the widening zone 31 is splayed.

This widening zone 31 acts in such a manner that the reservoir 8 is unable to be delimited at the top by the cutter 3 due to problems related to realizing a piece such as this by means of a moulding process. The covering 4 and the cutter 3 are, however, in direct contact so as to minimize possible deterioration of the solute present in the reservoir 8 due to moisture.

In this regard, the covering 4 defines an annular groove 43 in which one end of the cutter 3 is inserted, this groove being found on the opposite side with respect to the cutting edge 30.

Given that in this situation, rotation applied by the user on the covering 4 could easily be transferred onto the cutter 3, it is important that activation of the cutter 3 be guided in a suitable manner. In fact, if the cutter had a cutting edge designed to cut/break the reservoir by translational movement only, the tightening action carried out by a user could (even inadvertently) be accompanied by twisting/rotation with the risk of completely cutting the frangible mouth 20 (which would end up inside the container as a result). For the purpose of overcoming this drawback, the cutting edge of the cutter must be designed according to a geometry adapted to break the reservoir by rotation only. Movement of the cutter 3 from the rest configuration to the operative configuration is therefore activated by the tightening of the covering 4 along the cap 2.

Cutting of the frangible mouth 20 is associated with passage from the rest configuration to the operative configuration, the cut defining an arc of a circle that subtends an angle at the centre ranging between 250° and 300°, particularly ranging between 260° and 280°. This makes it possible to cut the frangible mouth 20 without running the risk of the latter dropping inside the container (in fact, this would obstruct subsequent extraction of the product present in the container). In this regard, at one end the cutter 3 comprises a circular perimeter and the cutting edge 30 involves less than 25% of this perimeter. The remaining parts of the perimeter extend along one imaginary plane (which is conveniently perpendicular to the straight line of movement of the cutter 3).

The capsule 1 conveniently comprises second toothed connection means 6, which, in the operative configuration, make said covering 4 and said cap 2 rotate integrally. This makes it possible to open and close the capsule like a normal cap once the solute present in the reservoir 8 has been released inside the container. In fact, the second connection means 6 act in such a manner that in the operative configuration, rotation applied by the user on the covering 4 determines the untightening/tightening of the cap 2 with respect to the container.

Figure 4:
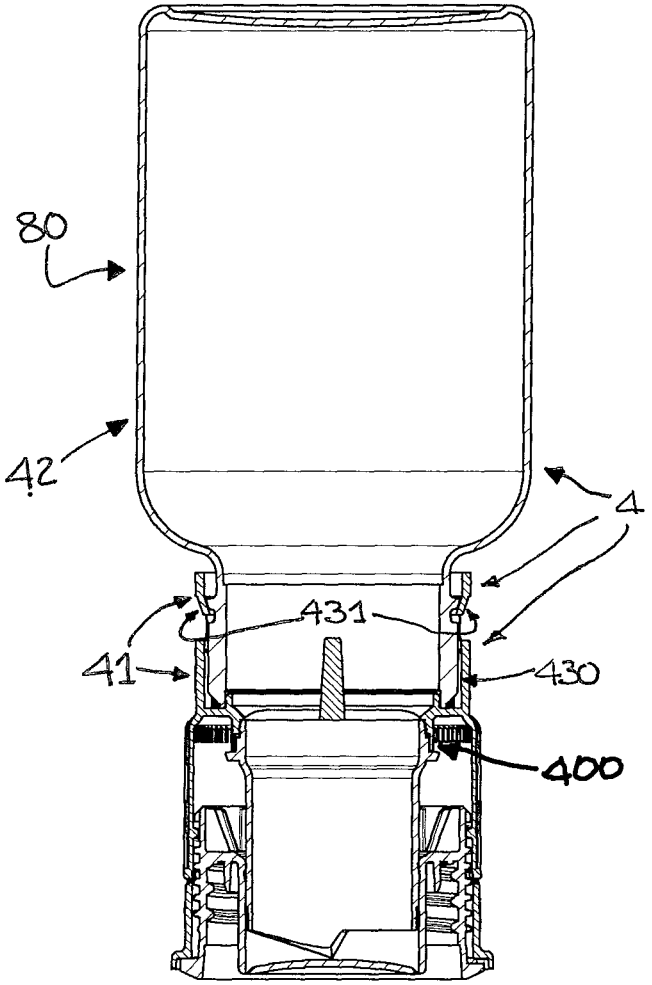
FIG. 4 is a sectional view showing an additional solution for a capsule, according to the present invention, connected to a container.

We shall now be referring to the solution illustrated by way of example in FIG. 4.

The covering 4 comprises a first portion 41, which, in turn, comprises a part of the first toothed connection means 5.

The covering 4 also comprises a second portion 42 that is removably connected to said first portion 41 (for example by means of threaded connection means or by means of press-fit engagement). The first and the second portion 41, 42 can be connected so that they rotate integrally (by way of non-limiting example by means of knurled elements 430 located on the first and the second portion 41, 42 and that interact with each other). Moreover, the first portion 41 can comprise an elastically deformable element (a ring) 431 that enables insertion of the second portion 42, preventing the extraction thereof.

The second portion 42 comprises a receptacle 80 that contributes to definition of said reservoir 8. Conveniently, this receptacle 80 consists of a single body. It has an inlet opening that faces said cutter 3. The inlet opening of the receptacle 80 advantageously projects inside the first portion 41 of the covering 4. In the solution illustrated by way of example in FIG. 4, the reservoir 8 has a volume of more than 100 $cm^3$. In the solution appearing in FIG. 1, the reservoir 8 has a volume of less than 50 $cm^3$.

The object of the present invention is also a system comprising:

- a container 7 for a liquid, comprising a mouthpiece 70;
- a capsule 1 having one or more of the characteristics described hereinabove; the cap 2 of the capsule 1 is connectable to the mouthpiece 70 of the container 7.

The object of the method is also a method for opening a container occluded by a closure capsule. Conveniently, the closure capsule 1 has one or more of the characteristics described hereinabove.

In particular, the capsule 1 comprises:

i) a cap 2 that can be associated with the container 7 and comprising a frangible mouth 20;

ii) a cutter 3 designed to open said frangible mouth 20;

iii) a covering 4 that protects said cap 2 and said cutter 3 and comprises an intactness band 40.

The method comprises the steps of:

removing the intactness band 40 (advantageously, this step comprises tearing the intactness band, which is advantageously connected to remaining parts of the covering 4 by means of connecting bridges);

cutting said frangible mouth 20, causing a substance present in a reservoir 8 defined at least by the combination of the cutter 3, the covering 4 and the frangible mouth 20 to drop into the container 7. In this manner, the substance (solute) present in the reservoir 8 is mixed with the solvent present in the container 7.

The step of cutting the frangible mouth 20 comprises the step of tightening at least a first part 400 of the covering 4 along the cap 2, thereby bringing about a rotational-translational movement of the cutter 3. The description provided hereinabove with reference to the first part 400 of the covering 4 can advantageously be extended to the entire covering 4 (once the intactness band has been removed, the covering 4 can be a single monolithic body or assembled in a number of pieces).

In fact, the cutter 3 and at least a first part 400 of the covering 4 are caused to rotate integrally by the first toothed connection means 5. Moreover, tightening the first part 400 of the covering 4 along the cap 2 also pushes the covering 4 on the cutter 3.

The step of cutting the frangible mouth 20 comprises cutting the frangible mouth 20 along an arc of a circle that subtends an angle at the centre ranging between 250° and 320°, leaving one edge of the frangible mouth 20 connected to the remaining parts of the cap 2.

The method also comprises the step of mutually interlocking second toothed connection means 6 afforded partly **6*a* on the covering 4 and partly 6*b* on the cap 2, causing the first part 400 of the covering 4 and the cap 2 to move integrally in the rotational-translational movement, so that the cap 2 and the first part 400 of the covering 4 remain solidly constrained during tightening and untightening of the cap 2 with respect to the container 7. In this manner, the capsule 1 can now be repeatedly tightened/untightened with respect to the container 7**.

The step of mutually interlocking the second toothed connection means 6 takes place upon completion of the step of tightening said covering 4 along the cap 2.

The object of the present invention is also a method for assembling a closure capsule having one or more of the characteristics described hereinabove. The assembly method conveniently comprises the steps of:

inserting part of the cutter 3 in the covering 4;

inserting in the cutter 3 the product to be dropped into the container 7 following breakage of the frangible mouth 20;

connecting the cutter 3 and the covering 4 with the cap 2, inserting at least an annular part of the cap 2 between the cutter 3 and the covering 4.

The present invention offers important advantages.

First of all, it makes it possible to provide capsules that have very capacious reservoirs for the solute, without this resulting in an excessive increase in the height of the capsule 1. The greater capacity of the reservoir also results in greater flexibility in terms of use of the capsule 1, which can be utilized for specific applications that are not possible with reservoirs of smaller sizes.

The invention thus conceived is susceptible to numerous modifications and variants, all of which falling within the scope of the inventive concept characterizing the invention. Moreover, all details may be replaced with other technically equivalent elements. All the materials used, as well as the dimensions, may in practice be of any type, according to needs.

The invention claimed is:

1. A closure capsule for closing a container, comprising:

a cap (2) that can be associated with a container and comprising a frangible mouth (20);

a cutter (3) comprising a cutting edge (30) designed to open said frangible mouth (20);

a covering (4) that protects both said cap (2) and said cutter (3) and comprises an intactness band (40);

characterized in that said closure capsule (1) is movable from a rest configuration, wherein the frangible mouth (20) and the intactness band (40) are intact, to an operative configuration, wherein the intactness band (40) is removed and the frangible mouth (20) is broken; in the rest configuration, the cap (2), the cutter (3) and the covering (4) contribute to the definition of walls of a reservoir (8) for containing a product to be dropped into the container in the operative configuration;

said closure capsule (1) comprising:

a first toothed connection means (5) afforded on the covering (4) and on the cutter (3) and that makes said cutter (3) and at least a first part (400) of said covering (4) rotate integrally;

a threaded connection means (9), which, in passing from the rest configuration to the operative configuration, couples the covering (4) and the cap (2), thereby bringing about rotational-translational movement of the first part (400) of the covering (4) and the cutter (3) with respect to said cap (2); the cutter (3) also comprising a widening zone (31), wherein, as it moves away from the cutting edge (30), the cross section of the cutter (3) increases.

2. The capsule according to claim 1, characterized in that cutting of the frangible mouth (20) is associated with passage from the rest configuration to the operative configuration, said cut defining an arc of a circle that subtends an angle at the centre ranging between 250° and 320°.

3. The capsule according to claim 1, characterized in that the operative configuration is assumed at a limit stop of the rotational-translational movement of the first part (400) of the covering (4) and the cutter (3) with respect to the cap (2).

4. The capsule according to claim 1, characterized in that it comprises a second toothed connection means (6), which, in the operative configuration, makes said first part (400) of the covering (4) and said cap (2) rotate integrally.

5. The capsule according to claim 1, characterized in that said covering (4) comprises:

a first portion (41) comprising a part of the first toothed connection means (5);

a second portion (42) that is connected to said first portion (41); said second portion (42) comprising a receptacle (80) that contributes to definition of said reservoir (8).

6. The capsule according to claim 5, characterized in that the first portion (41) comprises an elastically deformable ring (431) that enables insertion of the second portion (42), preventing the extraction thereof.

7. A system comprising:

a container (7) for a liquid, comprising a mouthpiece (70);

a capsule (1) according to claim 1; said cap (2) being connectable to the mouthpiece (70) of the container (7).

8. A method for assembling a closure capsule according to claim 1, characterized in that it comprises the steps of:

inserting part of the cutter (3) in the covering (4);

inserting in the cutter (3) the product to be dropped into the container (7) following breakage of the frangible mouth (20);

connecting the cutter (3) and the covering (4) with the cap (2), inserting at least an annular part of the cap (2) between the cutter (3) and the covering (4).

9. A method for opening a container occluded by a closure capsule comprising:

i) a cap (2) that can be associated with the container (7) and comprising a frangible mouth (20);

ii) a cutter (3) designed to open said frangible mouth (20);

iii) a covering (4) that protects said cap (2) and said cutter (3) and comprises an intactness band (40);

said method comprising the steps of:

removing the intactness band (40);

cutting said frangible mouth (20), causing a substance present in a reservoir (8) defined at least by the combination of the cutter (3), the covering (4) and the frangible mouth (20) to drop into the container (7); characterized in that the step of cutting said frangible mouth (20) comprises the step of tightening at least a first part (400) of said covering (4) along the cap (2), thereby bringing about a rotational-translational movement of the cutter (3); the cutter (3) and the first part (400) of the covering (4) being caused to rotate integrally by a first toothed connection means (5).

10. The method according to claim 9, characterized in that the step of cutting said frangible mouth (20) comprises cutting the frangible mouth (20) along an arc of a circle that subtends an angle at the centre ranging between 250° and 320°, leaving one edge of the frangible mouth (20) connected to the remaining parts of the cap (2).

11. The method according to claim 9, characterized in that a second toothed connection means (6) afforded partly on the covering (4) and partly on the cap (2) is mutually interlocked, causing the first part (400) of the covering (4) and the cap (2) to move integrally in the rotational-translational movement, so that the cap (2) and the first part (400) of the covering (4) remain solidly constrained during possible tightening/untightening of the cap (2) with respect to the container (7); the step of mutually interlocking the second toothed connection means (6) taking place upon completion of the step of tightening said covering (4) along the cap (2).

* * * * *